United States Patent [19]

Hughes

[11] Patent Number: 4,493,230

[45] Date of Patent: Jan. 15, 1985

[54] APPARATUS TO OPEN AND CLOSE A METER RING

[76] Inventor: Enoch A. Hughes, 13404 Wheeler Ave., Sylmar, Calif. 91342

[21] Appl. No.: 460,181

[22] Filed: Jan. 24, 1983

[51] Int. Cl.[3] ..... B25B 27/00

[52] U.S. Cl. ..... 81/3 R

[58] Field of Search ..... 29/238, 239, 271; 81/3 R

[56] References Cited

U.S. PATENT DOCUMENTS

| | | | |
|---|---|---|---|
| 2,806,392 | 9/1957 | Auger | 81/3 R |
| 3,015,883 | 1/1962 | Brown | 29/271 |
| 4,399,683 | 8/1983 | Hunter | 81/3 R X |

*Primary Examiner*—James G. Smith
*Attorney, Agent, or Firm*—Charles H. Schwartz; Ellsworth R. Roston

[57] ABSTRACT

An apparatus for opening and closing a meter ring wherein the ring includes end portions extending outwardly and with each end portion including at least one opening, including, an elongated handle, a head portion located at one end of the handle and with the head portion having a substantially cylindrical configuration, the head portion including an outwardly extending lug located at a first circumferential position and an outwardly extending strap including a hook at the end of the strap located at a second circumferential position, the lug for insertion into the opening in one of the end portions to capture the head portion between the end portions and with rotation of the elongated handle forcing the head portion between the end portions to spread the meter ring, and the hook at the end of the strap for insertion into the opening in the other of the end portions to have the strap extend across the end portions and with the head portion outside the one end portion and with rotation of the elongated handle forcing the head portion against the outside of the one end portion to force the end portions together to close the meter ring.

11 Claims, 7 Drawing Figures

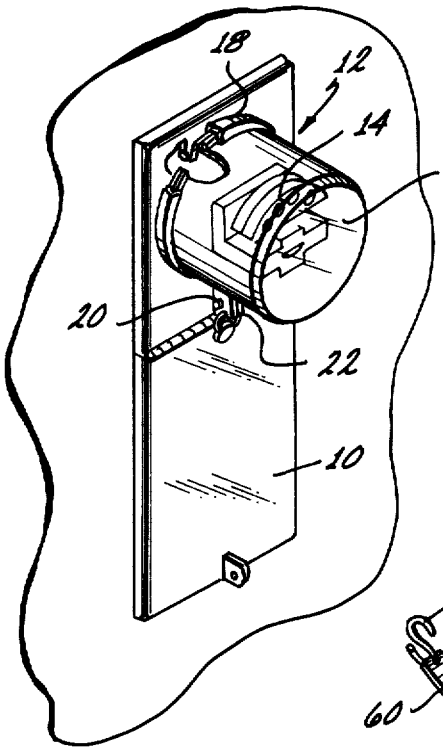
FIG. 1
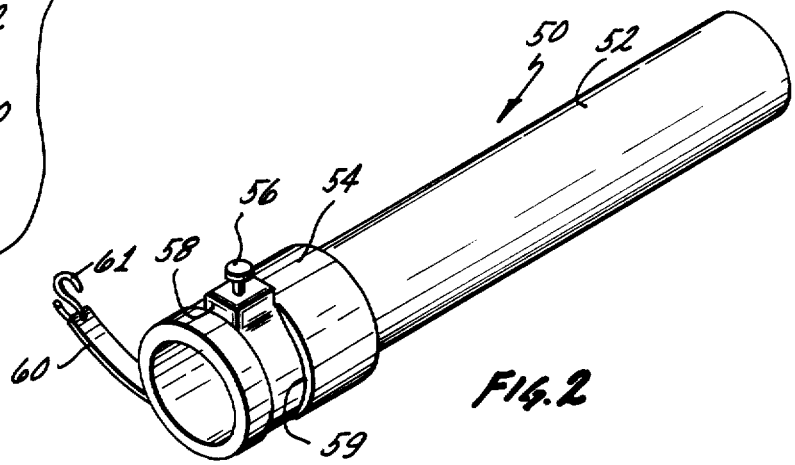
FIG. 2
FIG. 3
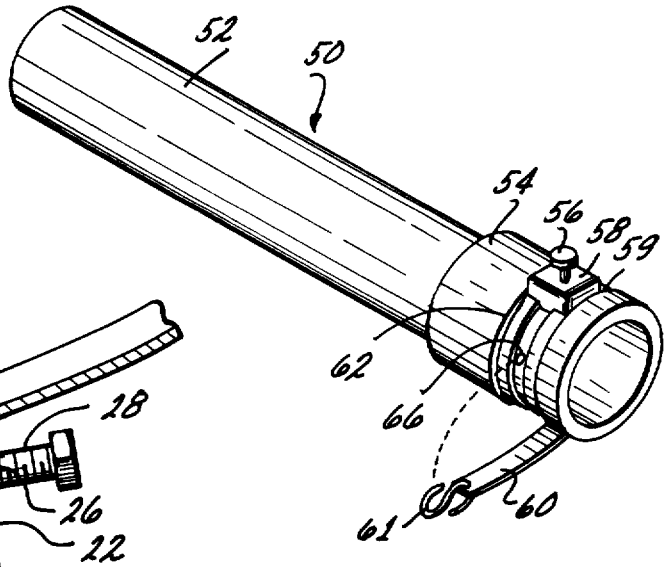
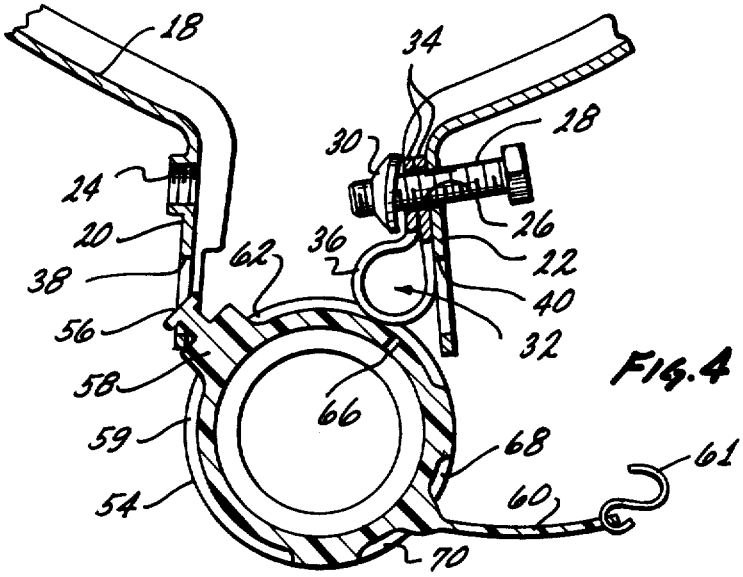
FIG. 4

APPARATUS TO OPEN AND CLOSE A METER RING

BACKGROUND OF THE INVENTION

1. Field of the Invention

The present invention relates to an apparatus or tool to open and close a meter ring such as a meter ring used to secure a glass cover around an electric or gas meter. The ring is disposed around the glass cover to prevent tampering of the meter by a subscriber.

2. Description of the Prior Art

Electric or gas meters generally include an indicator dial so that the meter may be read to determine the consumption of electricity or gas for billing a subscriber. In order to make the reading of the meter accessible to the meter reader, yet prevent the subscriber from tampering with the meter, such as by turning back the meter reading or disrupting the recording of the electric or gas consumption, the meter and in particular the dial indicator is generally enclosed by a glass cover.

The cover is formed as a cylinder having an open end and a closed end. The open end of the glass cover is locked in position around the meter by a split meter ring having ends extending outwardly from the ring. The ring is generally formed of steel and with the ends of the meter ring held together by a nut and bolt combination. The ends of the meter ring typically includes openings so that additional locking devices and/or a seal may pass between the ends. The seal must be broken in order to remove the meter ring so that a broken seal indicates that the meter has been tampered with.

In the prior art, the meter ring has been in general, installed or removed through the use of hand strength by the meter installer. That is, the meter ring is pulled open to be slipped around the cover and to be properly seated in position. The ends of the meter ring are then squeezed together, either by hand or by a conventional tool such as a pair of pliers, in order for the nut and bolt combination to be engaged to lock the meter ring in position. When the meter ring is to be removed, the reverse procedure is used to spread apart the ends of the meter ring to release the meter ring from its seated position.

For both operations of opening and closing the meter ring during installation and/or removal, the meter installer must exhibit considerable hand strength and such hand strength may not be present with a significant percentage of meter installers, especially since a higher percentage of installers are now female.

SUMMARY OF THE INVENTION

The present invention is directed to an apparatus or tool to open and close a meter ring. Specifically the present invention is directed to a tool which has two (2) modes of operation. In a first mode of operation the tool may be used to spread apart the ends of the meter ring for either seating the meter ring in position during installation of the meter ring, or for unseating the meter ring for removal of the meter ring. Once the meter ring has been seated in position during installation, the tool may now be used in a second mode of operation to pull the ends of the meter ring together so that the nut and bolt combination may lock the end of the meter ring in position.

The tool of the present invention includes an elongated handle portion supporting a substantially cylindrical head member and with the head member including a lug member at one circumferential position and a strap member with a hook at another circumferential position for use in providing the two (2) different modes of operation of the tool. The lug member is used to engage an opening in one end of the meter ring and with rotation of the tool and thereby the head member between the ends of the ring forcing the ends apart, to thereby spread the meter ring for easy insertion or removal of the meter ring. The strap and hook portion is used to engage another end of the meter ring and with rotation of the tool and thereby the head member on the outside of the one end of the meter ring providing for the ends of the ring to be forced together so that the nut and bolt combination may lock the ends. The outside cylindrical surface of the head member of the tool may include channels extending around the surface to guide the tool during operation of the tool. In addition, the outside cylindrical surface of the head member may include grooves extending across the surface to lock the tool in position during operation of the tool.

BRIEF DESCRIPTION OF THE DRAWING

A clearer understanding of the invention will be had with reference to the following description and drawing wherein:

FIG. 1 is a perspective view of a meter including a cover member and a locking ring;

FIG. 2 is a perspective view from one side of the tool to open and close a meter ring of the present invention;

FIG. 3 is a perspective view from the other side of the tool of FIG. 2;

FIG. 4 is a front cross-sectional view of the head member of the tool and showing the initial engagement of the end portions of the meter ring for spreading the meter ring;

DESCRIPTION OF THE PREFERRED EMBODIMENT

Figure 5:
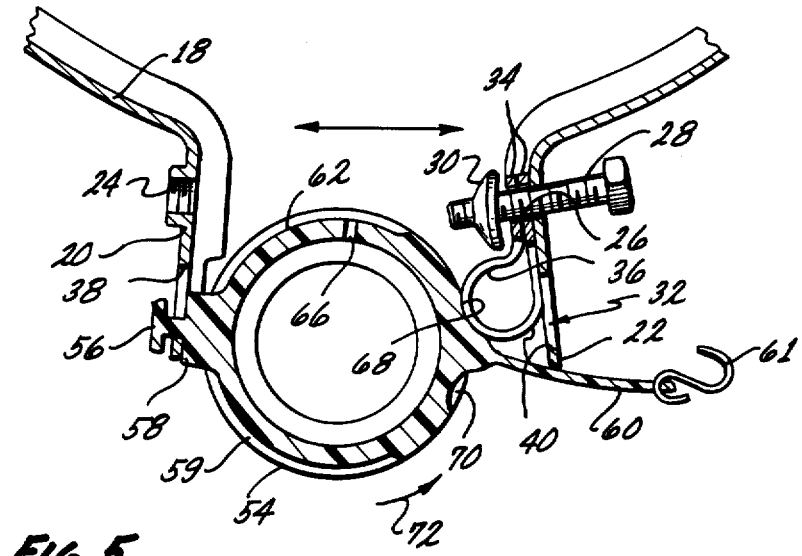
FIG. 5 is similar to FIG. 4 but with the tool fully spreading the meter ring.

As shown in FIG. 1, a panel 10 may support a meter 12 which meter includes an indicator dial 14. In order to allow the indicator dial 14 to be read while still protecting the meter 12 from tampering, a transparent cover 16 encloses the meter 12. The transparent cover 16 may be constructed of glass and may be cylindrical in form. The cover 16 has one closed end and one open end. The cover 16 is positioned around the meter 12 and with a meter ring 18 locking the cover 16 in position against the panel 10 in a known manner. The meter ring 18 includes outwardly extending end portions 20 and 22 which, when drawn together, squeezes the meter ring 18 around the open end of the cover 16 to lock the cover in position. The end portions 20 and 22 of the meter ring 18 may be more clearly seen with reference to FIGS. 4 through 7 wherein the two modes of operation of the apparatus of the present invention are illustrated.

The end portion 20 includes an integral nut member 24. The end portion 22 includes an opening 26 through which a bolt member 28 passes so as to be received within the nut member 24. A flexible washer 30 may be positioned over the bolt member to retain the bolt member within the opening 26 so that the bolt member will not be lost when the ends of the meter ring 18 are in the open position. The end 22 of the meter ring 18 also supports an integral stop member 32. The integral stop member 32 includes end portions 34, which have openings to pass the bolt member 28, and a loop portion 36. The loop portion 36 acts as a spacer to provide for a predetermined distance between the end portions 20 and 22 of the meter ring 18 when the bolt member 28 is fully threaded into the nut member 24. The end portions 20 and 22 of the meter ring 18 also include openings 38 and 40 which openings are normally used for the passage of a seal and/or an auxiliary locking device between the end portions once the meter ring has been installed. The use of a seal insures that there will be no tampering with the meter since such tampering cannot be accomplished without removing the meter ring and thereby breaking the seal.

The present invention is directed to a tool 50 for opening and closing the meter ring and the tool 50 is shown in detail in FIGS. 2 and 3. The tool 50 includes a handle member 52 formed as an elongated cylinder and with the handle member 52 supporting a head member 54. The handle 52 and head member 54 may be formed as separate members or may be formed as a unitary member. The handle and head members may be constructed of various materials and as a particular example a tough plastic such as a PVC material may be used to construct the tool of the present invention.

The head member 54 has a specific design to provide for the opening and closing of the meter ring 18. In particular, the head member 54 includes a lug 56 which extends outwardly from a shelf 58. As can be seen in FIGS. 4 through 7, the lug 56 and shelf 58 may be integrally molded with the head 54 but it is to be appreciated that these members may be formed as separate additions to the head 54. For example, the lug 56 may be constructed of metal and may be threaded or riveted through the shelf 58. Diametrically opposite to the lug 56 is a strap 60 and with a hook member 61 mounted at the end of the strap 60. As shown in FIGS. 4 through 7, the strap may be integrally molded with the head 54 or the strap may be a separately attached member.

The head member 54 also includes channels and grooves which help facilitate the operation of the tool 50. In particular, a channel 59 extends circumferentially around one side of the head 54 and a channel 62 extends circumferentially around the other side. In addition, the channel 62 may include a further channel 64 with an opening 66 so that the strap 60 may be wrapped close to the head 54 and with the hook 61 positioned in the opening 66 so as to provide for storage of the strap 60 when the tool is not in use. The head 54 also includes grooves 68 and 70 extending across the head and located on either side of the strap 60. The grooves 68 and 70 are also used during one mode of operation of the tool 50.

Figure 6:
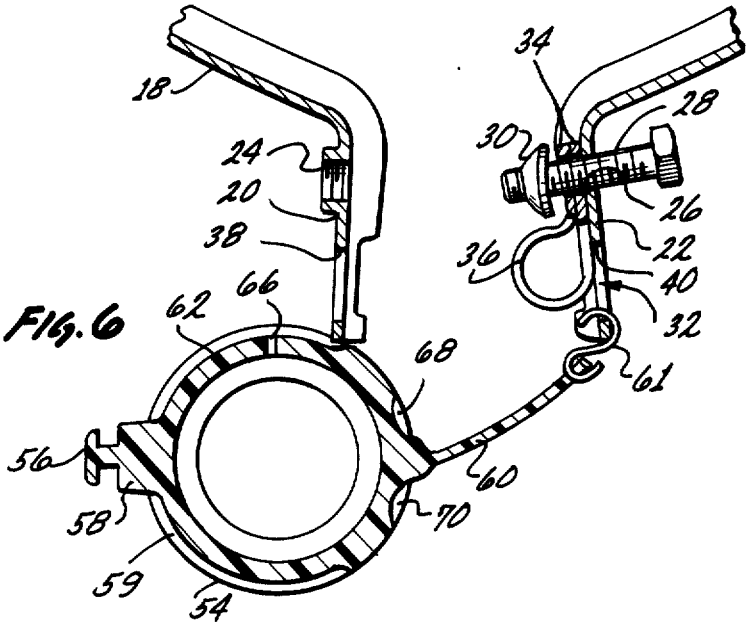
FIG. 6 is a front cross-sectional view of the head member of the tool and showing the initial engagement of the end portions of the meter ring for forcing the end portions together.
Figure 7:
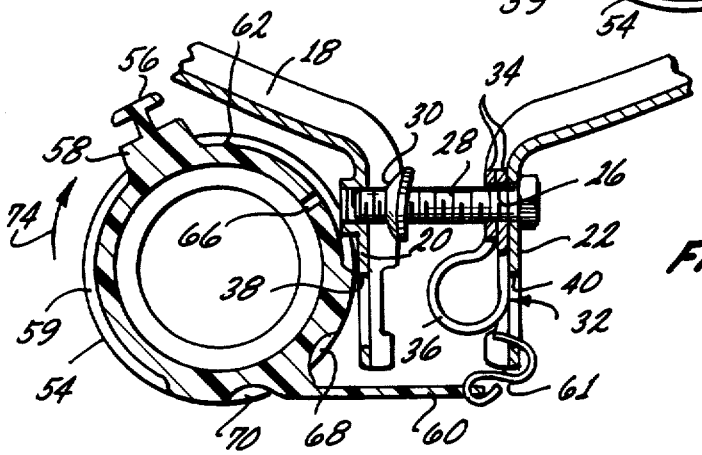
FIG. 7 is a view similar to FIG. 6 with the tool closing the end portions to allow the end portions of the meter ring to be locked together.

FIGS. 4 and 5 illustrate one mode of operation of the tool 50 for spreading apart the ends 20 and 22 of the meter ring 18. FIGS. 6 and 7 illustrate another mode of operation of the tool 50 for forcing together the ends 20 and 22 of the meter ring 18. The end of the meter ring 18 are spread apart, either when the meter ring is being positioned to lock the cover 16 in place, or when it is desired to remove the meter ring 18. For example, the meter ring is removed so as to remove the cover 16 and thereby gain access to the meter 12. The ends of the meter ring 18 are forced together when it is desired to lock the ends together through the use of the nut 24 and bolt 28 combination.

As can be seen in FIG. 4, the tool 50 is positioned to have the lug 56 engage the bottom edge of the opening 38 in the end 20 of the meter ring 18. The loop portion 36 of the stop 32 is then positioned within the channel 62. The hook 61 at the end of the strap 60 would have been previously removed from the opening 66 so that the strap and hook can extend outward as shown in FIG. 4. The tool 50 is then operated in the following manner as shown in FIG. 5.

Specifically, the tool 50 is rotated in a counter-clockwise direction, as shown by the arrow 72, and with the tool rotated until the loop portion 36 seats itself in the groove 68. At this time, the shelf portion 58 engages the lower part of the end 20 of the meter ring 18. The ends 20 and 22 of the meter ring 18 are now spread apart thereby also spreading apart the meter ring, so that the meter ring may either be positioned around the cover 16 prior to seating the meter ring for locking the cover 16 in position or conversely, for removing the meter ring.

The particular position shown for the meter ring 18 is the normal position but it is possible to install the meter ring backwards so that the ends are reversed and with the loop portion 36 to the left. The head therefore, also includes a channel 59 and a groove 70 so that the tool 50 may be used to spread apart the meter ring with a clockwise rotation, even if the meter ring is backwards.

Assuming that the meter ring 18 has been positioned around the cover 16 and has been properly seated in position, the tool 50 is removed and may now be used as shown in FIGS. 6 and 7 for forcing the ends 20 and 22 of the meter ring together so that the ends may be held together by the nut and bolt combination. As shown in FIG. 6, the hook 61 is positioned to hook over the lower part of the opening 40 in the end portion 22 of the meter ring 18. The tool 54 is then rotated in a clockwise direction as shown by the arrow 74 in FIG. 7 so that the ends 20 and 22 are forced together as shown in FIG. 7.

When the ends 20 and 22 are in the position, as shown in FIG. 7, the bolt 28 is turned to engage the nut 24 and with the bolt tightened to eventually bring the ends together. At this time the loop portion 36 engages the end portion 20 and with the loop portion 36 thereby operating as a stop member to provide for a predetermined distance between the ends 20 and 22. The meter ring 18 is now locked in position around the cover 16 as shown in FIG. 1. The ends 20 and 22 may be further locked with a locking device, such as a padlock, and/or a seal may be also used, by passing a wire member through the openings 38 and 40 and with the ends of the wire sealed together, so that any tampering with the meter ring 18 will be obvious to the meter reader.

It can be seen therefore, that the present invention provides for a simple tool used to open and close a meter ring and with the tool including a head member having a lug portion at one position and a strap member at another position and with the head member including channels and grooves so as to provide for the tool engaging the ends of the meter ring to open the meter ring when desired and to close the meter ring when desired.

Although the invention has been described with reference to a particular embodiment, it is to be appreciated that various adaptations and modifications may be made and the invention is only to be limited by the appended claims.

I claim:

1. An apparatus for opening and closing a meter ring wherein the ring includes end portions extending outwardly and with each end portion including at least one opening, including, an elongated handle, a head portion located at one end of the handle and with the head portion having a substantially cylindrical configuration, the head portion including an outwardly extending lug located at a first circumferential position and an outwardly extending strap including hook at the end of the strap located at a second circumferential position, the lug for insertion into the opening in one of the end portions to capture the head portion between the end portions and with rotation of the elongated handle forcing the head portion between the end portions to spread the meter ring, and the hook at the end of the strap for insertion into the opening in the other of the end portions to have the strap extend across the end portions and with the head portion outside the one end portion and with rotation of the elongated handle forcing the head portion against the outside of the one end portion to force the end portions together to close the meter ring.

2. The apparatus of claim 1 wherein the head portion additionally includes at least one channel extending circumferentially around the head member for guiding the other end portion during rotation of the head portion between the end portions.

3. The apparatus of claim 1 wherein the head portion additionally includes a groove extending across the head portion for receiving and locking the other end portion within the groove after the head portion has been fully rotated between the end portions.

4. The apparatus of claim 1 wherein the head portion includes a shelf at the first circumferential position and with the lug extending outwardly from the shelf and with the shelf supporting the one end portion when the head portion is rotated between the end portions.

5. The apparatus of claim 1 wherein the head portion includes an opening to receive the hook at the end of the strap to store the strap against the cylindrical surface of the head portion.

6. The apparatus of claim 1 wherein the first and second circumferential positions are diametrically opposite to each other.

7. A tool for use in opening and closing a meter ring wherein the ring includes outwardly extending ends and a nut and bolt combination to lock the ends together and with each end including openings and with one end supporting a spacer loop to provide a predetermined spacing between the ends, the tool including a handle member supporting an enlarged head member at one end of the handle, the head member including a lug extending from the head at a first position on the head and a strap extending from the head at a second position on the head diametrically opposite to the first position and with a hook at the end of the strap, the head member including at least one channel extending from the lug along the head, and the head member including at least one groove extending across the head and located adjacent the strap.

8. The tool of claim 7 wherein at least one channel guides the other end during rotation of the head member between the ends.

9. The tool of claim 7 wherein the at least one groove receives and locks the spacer loop within the groove after the head member has been fully rotated between the ends.

10. The tool of claim 7 wherein the head member includes a shelf at the first position and with the lug extending outwardly from the shelf and with the shelf supporting the one end when the head member is rotated between the ends.

11. The tool of claim 7 wherein the head member includes an opening to receive the hook to store the strap against the surface of the head member.

* * * * *